US012758813B2

(12) United States Patent
Anant Deshpande

(10) Patent No.: US 12,758,813 B2
(45) Date of Patent: Oct. 13, 2026

(54) DUMBBELL WITH ROTATING HANDLE AND PENDULATING WEIGHTS

(71) Applicant: Deepak Anant Deshpande, Katy, TX (US)

(72) Inventor: Deepak Anant Deshpande, Katy, TX (US)

( * ) Notice: Subject to any disclaimer, the term of this patent is extended or adjusted under 35 U.S.C. 154(b) by 223 days.

(21) Appl. No.: 18/152,984

(22) Filed: Jan. 11, 2023

(65) Prior Publication Data

US 2024/0226640 A1 Jul. 11, 2024

(51) Int. Cl.
*A63B 21/072* (2006.01)

(52) U.S. Cl.
CPC ..... *A63B 21/0726* (2013.01); *A63B 21/0728* (2013.01)

(58) Field of Classification Search
CPC ..... A63B 21/0726; A63B 21/0728; A63B 21/072–075
See application file for complete search history.

(56) References Cited

U.S. PATENT DOCUMENTS 460,270 A * 9/1891 Somerby ..... A63B 21/0608 482/110
734,062 A * 7/1903 Harris ..... A63B 21/075 482/108
3,756,597 A 9/1973 Monti
3,929,331 A * 12/1975 Beeding ..... A63B 21/015 73/862.08
4,043,553 A 8/1977 Suarez
4,231,569 A 11/1980 Rae
4,743,017 A * 5/1988 Jaeger ..... A63B 21/0728 482/108
4,756,526 A * 7/1988 Broussard ..... A63B 21/0724 482/93
4,768,780 A * 9/1988 Hayes ..... A63B 21/0724 482/106
4,880,229 A * 11/1989 Broussard ..... A63B 21/0724 482/106
5,628,716 A * 5/1997 Brice ..... A63B 21/0728 482/106
D398,675 S * 9/1998 Marney ..... D21/681
(Continued)

FOREIGN PATENT DOCUMENTS

DE 102011050045 A1 * 11/2012 ..... A63B 21/22

OTHER PUBLICATIONS

Translation of DE-102011050045-A1 (Year: 2012).*

*Primary Examiner* — Megan Anderson
*Assistant Examiner* — Catrina A Letterman
(74) *Attorney, Agent, or Firm* — Adair Myers Stevenson Yagi PLLC; Matthew Compton

(57) ABSTRACT

A weightlifting dumbbell device comprising a round bar with a coaxial tubular handle that rotates on the bar and a mass element disposed fixedly on each end of the bar in such a way that the center of mass of both mass elements are equally offset in the same direction perpendicular to the longitudinal axis of the bar so that during an exercise regimen both the mass elements can pendulate together around the handle, which allows the exerciser to curl the handgrip at the wrist with ease and thereby stabilize the weightlifting dumbbell device, relax the secondary muscles and consequentially isolate and boosts the workout of the participating primary muscles.

8 Claims, 8 Drawing Sheets

(56) References Cited

U.S. PATENT DOCUMENTS

| | | | | |
|---|---|---|---|---|
| 6,022,300 | A * | 2/2000 | Hightower | A63B 21/0728 482/106 |
| 6,045,467 | A * | 4/2000 | Anderson | A63B 59/50 473/568 |
| 7,815,553 | B2 | 10/2010 | Song | |
| 8,118,717 | B1 | 2/2012 | Lai | |
| 8,251,878 | B2 | 8/2012 | Liu | |
| 2004/0242385 | A1* | 12/2004 | Emick | A63B 21/0783 482/106 |
| 2010/0075811 | A1* | 3/2010 | Huang | A63B 21/0724 482/93 |
| 2010/0087297 | A1* | 4/2010 | Kanaoka | A63B 21/4035 482/108 |
| 2013/0040790 | A1* | 2/2013 | Morris | A63B 21/0726 482/108 |
| 2014/0005013 | A1* | 1/2014 | Kassemi | A63B 21/4035 482/108 |
| 2014/0274598 | A1* | 9/2014 | Anderson | A63B 21/0728 482/108 |
| 2014/0287889 | A1* | 9/2014 | Grace | A63B 21/0783 482/106 |
| 2015/0038303 | A1* | 2/2015 | Adkins | A63B 21/0726 482/108 |
| 2017/0087407 | A1* | 3/2017 | Kravchenko | A63B 21/0726 |
| 2017/0319895 | A1* | 11/2017 | Davis | A63B 23/1236 |
| 2018/0296873 | A1* | 10/2018 | Amyan | A63B 21/0722 |
| 2023/0112052 | A1* | 4/2023 | Kravchenko | A63B 21/072 482/108 |
| 2025/0058165 | A1* | 2/2025 | Lower | A63B 21/0726 |

* cited by examiner

Section Y-Y

DUMBBELL WITH ROTATING HANDLE AND PENDULATING WEIGHTS

CROSS-REFERENCES

Provisional Application Number: 63/325,247
Filed on: 30 Mar. 2022
Title of Invention: DUMBBELL WITH ROTATING HANDLE AND PENDULATING WEIGHTS
Inventor: Deepak Anant Deshpande
Application Type: Provisional

REFERENCE TO RELATED PATENTS

U.S. Patent Documents

U.S. Pat. No. 78,155,53 October 2010 Song . . . 482/93
U.S. Pat. No. 60,22,300 February 2000 Hightower . . . 482/106
U.S. Pat. No. 4,231,569 November 1980 Rae . . . 272/122
U.S. Pat. No. 8,118,717 February 2012 Lai . . . 482/108
U.S. Pat. No. 8,251,878 August 2012 Liu . . . 482/110
U.S. Pat. No. 3,756,597 September 1973 Monti . . . 272/81
U.S. Pat. No. 4,043,553 August 1977 Suarez . . . 272/128

BACKGROUND OF THE INVENTION

There is an emphasis and importance being placed upon achieving good health and physical fitness, and more attention is being given to various ways of providing exercise for the human body. Many free weightlifting exercises can be performed by raising and lowering a barbell or a dumbbell or a kettlebell along a curved path about some axis. The axis itself passes through some joint of the body such as the elbow or the shoulder. Two categories of muscles participate in a free weight exercise. The primary muscles provide most of the force and energy for the exercise and are usually those muscles that are intended to be exercised. The associated secondary muscles assist the primary muscles primarily to counterbalance the destabilizing forces encountered during the free weight exercise.

For example, in the biceps curl exercise with a standard dumbbell the biceps brachii is the primary muscle that lifts the weight on the dumbbell. The muscles in the forearm, wrist, palm, and fingers are the associated secondary muscles that help to counter the destabilizing forces on the hand from the dumbbell. One of such destabilizing force is generated by the rotational inertia of the weights on the dumbbell as the dumbbell goes through a curvilinear path during the exercise. The inertial force is transferred to the wrist and secondary muscles via the friction between the handle of the dumbbell and the exerciser's handgrip. As a result, the exerciser's handgrip around the bar is strained and may loosen. However, the secondary muscles contract, tightening the exerciser's fingers around the handle and at the same time counterbalancing the inertial force. A rotatable handle has been used on some weightlifting bars to isolate the exerciser's handgrip from the weights and thereby reduce the destabilizing effects on the exerciser. The weights on some of these weightlifting bars pendulate on their own during the exercise which could help to further stabilize the weightlifting device.

BRIEF STATEMENT OF THE INVENTION

The present invention relates to a free weight exercise device, and more particularly, to a new and improved weightlifting dumbbell device with a rotatable handle and pendulating weights which relax the secondary muscles that support the wrist and at the same time increases the workout of the participating primary muscles during an exercise.

PRIOR ART

Prior arts noted below disclose weightlifting bars, with rotatable handles and pendulating weights. U.S. Pat. No. 7,815,553 (Song) discloses an exercise apparatus with T-shaped configuration. All three legs of the T-shape rotate independent of one another on three separate rotating joints. The shorter two legs of the T-shape form two separate handles that are held simultaneously in both hands to maneuver the exercise apparatus during the exercises. The longer leg of the T-shape carries the weights. The rotating joints always keep the longer leg vertical, due to gravity, during the exercise performed on this apparatus. The rotating handles and verticality of the weight help to protect the users joint according to this patent. It is clear from the disclosure of this patent that this exercise apparatus cannot be used to perform many of the exercises that are performed with a typical dumbbell because of its T-shape and need to hold the exercise apparatus by both hands. The two handles on this exercise apparatus are not connected to one another and rotate independent of each other in two separate rotating joints. The handles could therefore rotate by different angles or at different speeds during the exercise making it difficult to manage the device.

U.S. Pat. No. 6,022,300 (Hightower) discloses a barbell device made of a bar with pair of multi-positional rotating hand grips, rigidly attached to the bar and with an swiveling offset configuration of circular weights supported at the two ends of the bar. The exerciser grips the bar directly via both the handles. While the offset weights pendulate in the swivel joints, the bar is firmly gripped by the exerciser. As per the inventor, the offset weights provide an excellent avenue for rehabilitating injured muscles and increase the effects of exercising the rotator muscles, shoulder muscles, arm muscles, and hand muscles. This device has to be held in both hands and therefore cannot be used as a dumbbell which is usually held in one hand. The weights on each end of this device are not rigidly connected and can pendulate independent of one another. Therefore, during an exercise it is possible that the two pendulating weight could be in different angular positions around the barbell or could be swinging at different angular speeds, due to unequal friction in the two swivel joints or due to unequal inertial force on the two weights. Such a situation could generate additional destabilizing forces on the device. This device also has notably many rotating or swiveling joints which could make it further difficult for the exerciser to counter these destabilizing forces.

U.S. Pat. No. 4,231,569 (Rae) discloses a device for bicep curl exercise. The handle of the device is rotatably disposed within a frame member and the weight to be lifted is also disposed in the same frame member at a predetermined distance from the handle. The weight remains at the predetermined distance from the handle along a curvilinear path all throughout the exercise. The biceps must accordingly continue to exert a same steady force to support the weight throughout the bicep curl exercise. It can therefore be inferred that the destabilizing force on the participating secondary muscles remains unchanged and high throughout the exercise.

U.S. Pat. No. 8,118,717 (Lai) discloses a dumbbell with rotating eccentric weights. The weights are curved segments. The curved weights are eccentrically and rotatably attached to each end of the dumbbell bar in such a way that the center of mass of the curved weight is offset from the linear axis of the dumbbell bar. U.S. Pat. No. 8,251,878 (Liu), U.S. Pat. No. 3,756,597 (Monti) and U.S. Pat. No. 4,043,553 (Suarez) disclose similar exercise apparatuses in which weights extend in a pendulum fashion downwardly from each end of the bar.

The exercise devices described in U.S. Pat. No. 7,815,553 (Song), U.S. Pat. No. 6,022,300 (Hightower) and U.S. Pat. No. 3,756,597 (Monti), must be grasped with both the hands during the exercise, and therefore cannot be used as dumbbells. The pendulating weights in the exercise devices described in U.S. Pat. No. 7,815,553 (Song) and U.S. Pat. No. 6,022,300 (Hightower) could destabilize the device for the reasons noted above.

For the weightlifting devices described in patents U.S. Pat. No. 8,118,717 (Lai), U.S. Pat. No. 8,251,878 (Liu), U.S. Pat. No. 3,756,597 (Monti), and U.S. Pat. No. 4,043,553 (Suarez), the exerciser has to make an extra effort to pendulate the weights and generate the resistance for the exercise. By doing so, additional destabilizing forces could be induced on the exerciser. Major proportion of the resistance for the exercise from these devices comes from the inertial force of the swinging weights rather than the dead weight of the device. The workout capacity of these dumbbell devices is therefore limited by the amount of this inertial force that the exerciser can generate. In contrast, the workout capacity of a standard dumbbell which is determined by the dead weight of the dumbbell, can be varied by changing the weights on the dumbbell.

The construction of many of the devices noted above is complex and sometimes unwieldy to the extent that they are not suitable for carrying out many of maneuvers and exercises performed with a standard dumbbell.

Therefore, there is a need for a well-balanced weightlifting dumbbell device that may be held in one hand and on which a rotatable handle and self pendulating weights may be deployed to reduce the destabilizing forces on exerciser's palm and wrist during the exercise. The structure of the device may be simple enough to allow the exerciser to perform most of the dumbbell standard exercises. The workout capacity of the device may be adjusted by changing the dead weight on the device.

SUMMARY OF INVENTION

The weightlifting dumbbell device of the present invention described and claimed herein comprises a round bar with a coaxial tubular handle that rotates on the bar and a mass element disposed fixedly on both ends of the bar in such a way that the center of mass of both mass elements are equally offset in the same direction perpendicular to the longitudinal axis of the bar. During the exercise the mass elements, which are connected to one another by the bar, pendulate together due to gravity and their center of mass are all the time plumb below the longitudinal axis of the bar. As a result, the weights elements do not generate the rotational inertia force on the wrist, unlike the standard dumbbell. Moreover, the handle spins on the bar which makes it easier for the exerciser to curl his or her handgrip at the wrist and thereby stabilize the weightlifting dumbbell device, relax the secondary muscles and consequentially isolate and boosts the workout of the participating primary muscles. Both the mass elements being fixedly connected to one another by the bar, pendulate together concurrently during the exercise which helps to maintain the balance and stability of the device.

BRIEF DESCRIPTION OF FIGURES AND PHOTOS

DETAILED DESCRIPTION OF THE INVENTION

Figure 1:
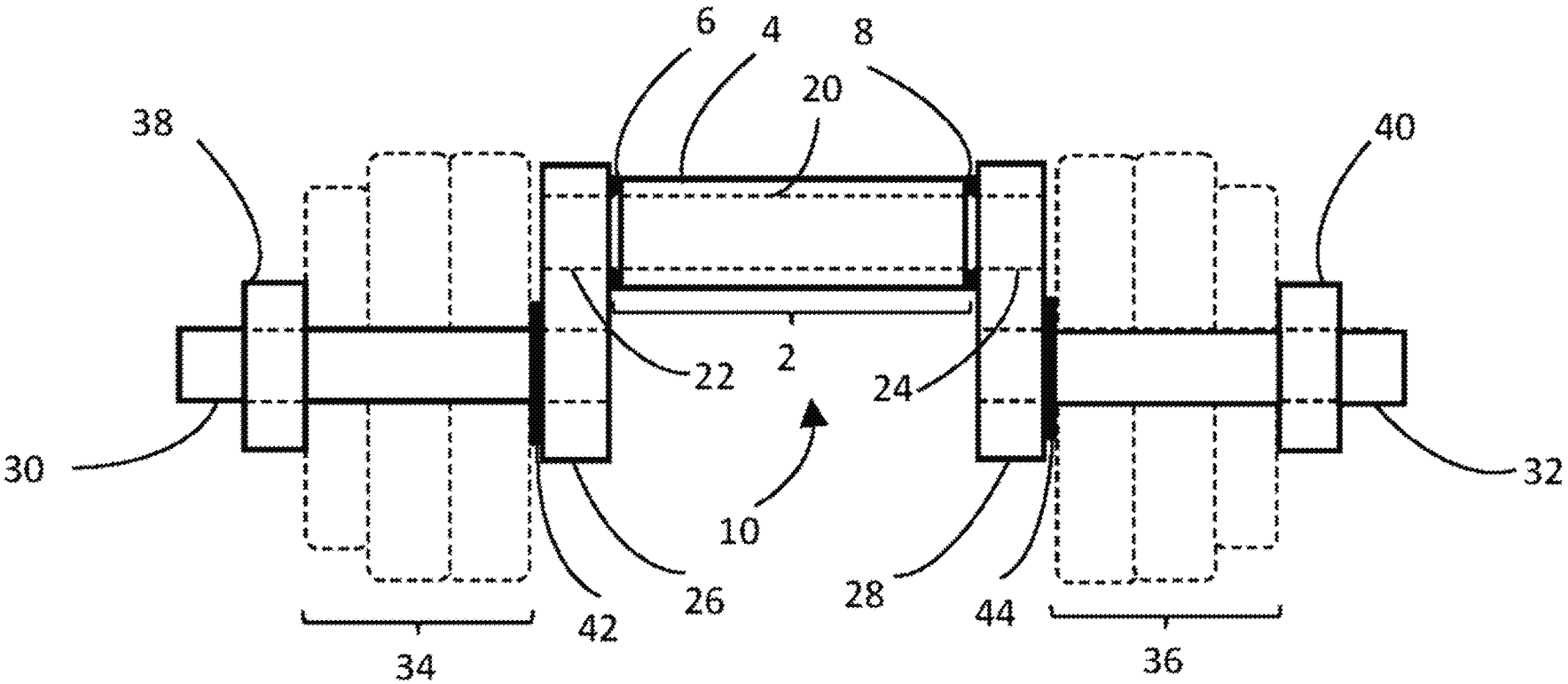
FIG. 1 is an elevation view of a weightlifting dumbbell device according to a first embodiment of present invention.

FIG. 1 shows a first embodiment of the weightlifting dumbbell device of the present invention described and claimed herein. The weightlifting dumbbell device comprises a round main bar 10 having an intermediate segment 20 and end segments 22 and 24. The main bar 10 includes a primary axis lengthwise. The intermediate segment 20 includes a center point. An offset means in form of brackets 26 and 28 are mounted rigidly on the end segments 22 and 24 respectively. The length of the end segments 22 and 24 is just enough to accommodate the brackets 26 and 28 thereon respectively. The opposite end of the brackets 26 and 28 rigidly support auxiliary bars 30 and 32 respectively. Both the brackets 26 and 28 extend in the same direction perpendicular to the primary axis. Handle assembly 2 comprising of a rotatable handle 4 and snap retaining rings 6 and 8 are mounted coaxially around the intermediate segment 20 in between the brackets 26 and 28. The handle 4 is used to grasp the weightlifting dumbbell device. A detailed description of the handle assembly 2 is given later along with FIG. 5. The auxiliary rods 30 and 32 extend from the brackets 26 and 28 respectively in the direction parallel to the primary axis and away from the center point. Auxiliary rods 30 and 32 respectively receive a set of weight plates 34 and 36 of same mass quantity. The weight plates are standard weights plates typically used for weightlifting exercise in a gymnasium. Fasteners 38 and 40 that engage respectively with the auxiliary rods 30 and 32 secure the weight plates on the brackets 26 and 28 respectively and restrict their linear and rotational movement relative to the auxiliary rods The fasteners 38 and 40 may be selected from a group of standard fasteners used on standard barbells to secure weight plates. For end segments with plane outer surface as shown in FIG. 1, the group of fasteners include clamp style collars, lock style collars and spring style collars. For end segments with external threads, said group of fasteners include anti-slip spin-lock collars and threaded anti-slip nuts. Flat disc elastomer washers 42 and 44 are mounted around the auxiliary rods 30 and 32 immediately next to the brackets 26 and 28 respectively allowing the fasteners 38 and 40 to further secure the weight plates on the brackets 26 and 28 respectively. The brackets 26 and 28 equally offset the center of mass of all the weight plates in the same direction perpendicular to the primary axis. Therefore, throughout a standard dumbbell exercise, as long as the handle 4 is horizontal, the weight plates, which are rigidly coupled to one another by the main bar 10, pendulate together around the handle 4 under the influence of gravity in such a way that the center of mass of all the weight plates lie plumb below the primary axis. As a result, as the weightlifting dumbbell device rises, the handle 4 spins around the main bar 10 towards the exerciser. Therefore, the exerciser can easily curl his or her handgrip at the wrist towards the body and thereby stabilize the weightlifting dumbbell device, relax the secondary muscles and consequentially reduce the associated arm pump. As the exerciser's handgrip curls, the secondary muscles relax and stretch to a lesser extent. Accordingly, the contribution of the secondary muscles to the overall force exerted by the exerciser's arm to lift the weightlifting dumbbell device reduces. The participating primary muscles must therefore exert more force to lift the weightlifting dumbbell device in order to compensate for the reduced support from the secondary muscles. Consequently, the workout of the primary muscle increases and less energy is wasted in working out the secondary muscles. The weight plates are rigidly coupled to one another by the main bar 10. They therefore pendulate concurrently during the exercise regimen. This prevents the development of any unbalanced forces originating from the pendulating weights. When the exerciser lowers the weightlifting dumbbell device, the handle 4 spins around the bar 10 away from the exerciser, which allows the exerciser to easily curl his or her handgrip at the wrist away from the body with and thereby stabilize the wrist and relax the secondary muscles that support the wrist.

Figure 2:
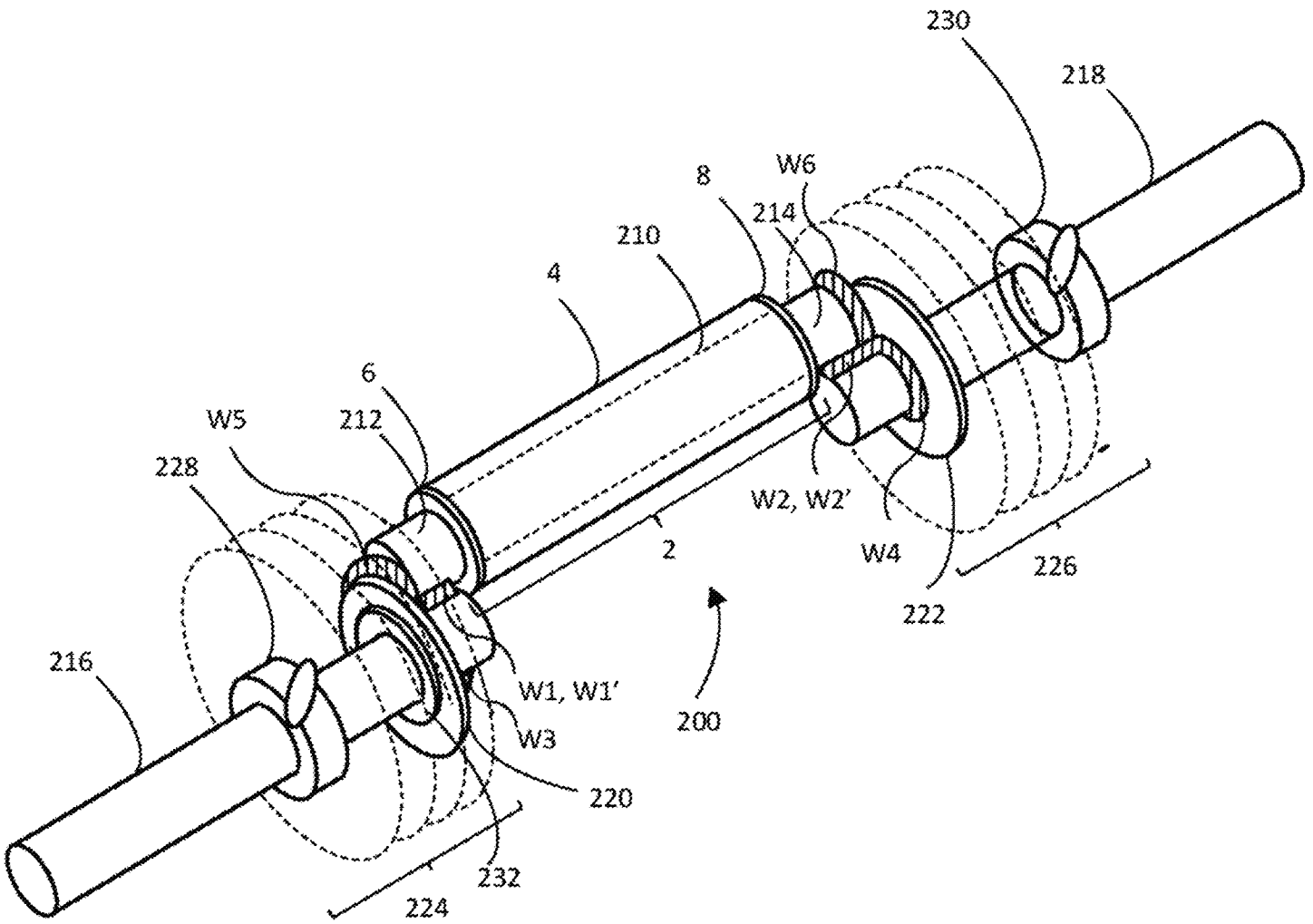
FIG. 2 is a perspective view of a weightlifting dumbbell device according to a second embodiment of present invention.

FIG. 2 shows second alternative embodiment of the weightlifting dumbbell device of the present invention described and claimed herein. The weightlifting dumbbell device comprises a round main bar 200 having an intermediate segment 210 and end segments 212 and 214. The main bar 200 includes a primary axis lengthwise. The intermediate segment 210 includes a center point. The round auxiliary rods 216 and 218 are attached to the end segments 212 and 214 respectively at the outer circumference of the end segment. The auxiliary rods 216 and 218 extend in the direction parallel to the primary axis and away from the center point. The longitudinal axes of the auxiliary rods 216 and 218 are collinear with each other, and parallel to the primary axis, which primary axis includes the radial center of end segments 212 and 214 respectively. The auxiliary rods 216 and 218 partially overlap the end segments 212 and 214 respectively and are equidistant from the center point. The auxiliary rods 216 and 218 are welded directly to the end segments 212 and 214 respectively along the weld seams W1 and W1' and W2 and W2' respectively on both sides of the overlaps. Therefore, the longitudinal axes of the auxiliary rods 216 and 218 are both at an equal offset in the same direction perpendicular to the primary axis. Handle assembly 2 comprising of a rotatable handle 4 and snap retaining rings 6 and 8 is mounted coaxially around the intermediate segment 210 in between the auxiliary rods 216 and 218. The handle 4 is used to grasp the weightlifting dumbbell device. A detailed description of the handle assembly 2 is given later along with FIG. 5. Flat disc metal washers 220 and 222 are respectively mounted around the auxiliary rods 216 and 218 immediately next to the end segments 212 and 214 respectively. The metal washers 220 and 222 are welded respectively to the auxiliary rods 216 and 218 by weld seams W3 and W4 respectively and also welded to the end segments 212 and 214 by weld seams WS and W6 respectively. Auxiliary rods 216 and 218 respectively receive a set of weight plates 224 and 226 with same mass quantity. The weight plates are standard weights plates typically used for weightlifting exercise in a gymnasium. Fasteners 228 and 230 that respectively engage with the auxiliary rods 216 and 218 secure the weight plates on the metal washers 220 and 222 respectively and restrict their linear and rotational movement relative to the auxiliary rods. The fasteners 228 and 230 may be selected from a group of standard fasteners used on standard barbells to secure weight plates. For end segments with plane outer surface as shown in FIG. 2, the group of fasteners include clamp style collars, lock style collars and spring style collars. For end segments with external threads, said group of fasteners include anti-slip spin-lock collars and threaded anti-slip nuts. Flat disc elastomer washers 232 and 234 are respectively mounted around the auxiliary rods 216 and 218 immediately next to the metal washers 220 and 222 respectively, allowing the fasteners 228 and 230 to further secure the weight plate on the metal washers 220 and 222 respectively. The center of mass of all the weight plates received by the auxiliary rods 216 and 218 are equally offset in the same direction perpendicular to the primary axis. Therefore, throughout a standard dumbbell exercise, as long as the handle 4 is horizontal, the weight plates, which are rigidly coupled to one another by the main bar 200, pendulate together around the handle 4 under the influence of gravity in such a way that the center of mass of all the weight plates lie plumb below the primary axis. As a result, the handle 4 spins and effects the exerciser's secondary and primary muscles in the same way as described before in this section.

Figure 3:
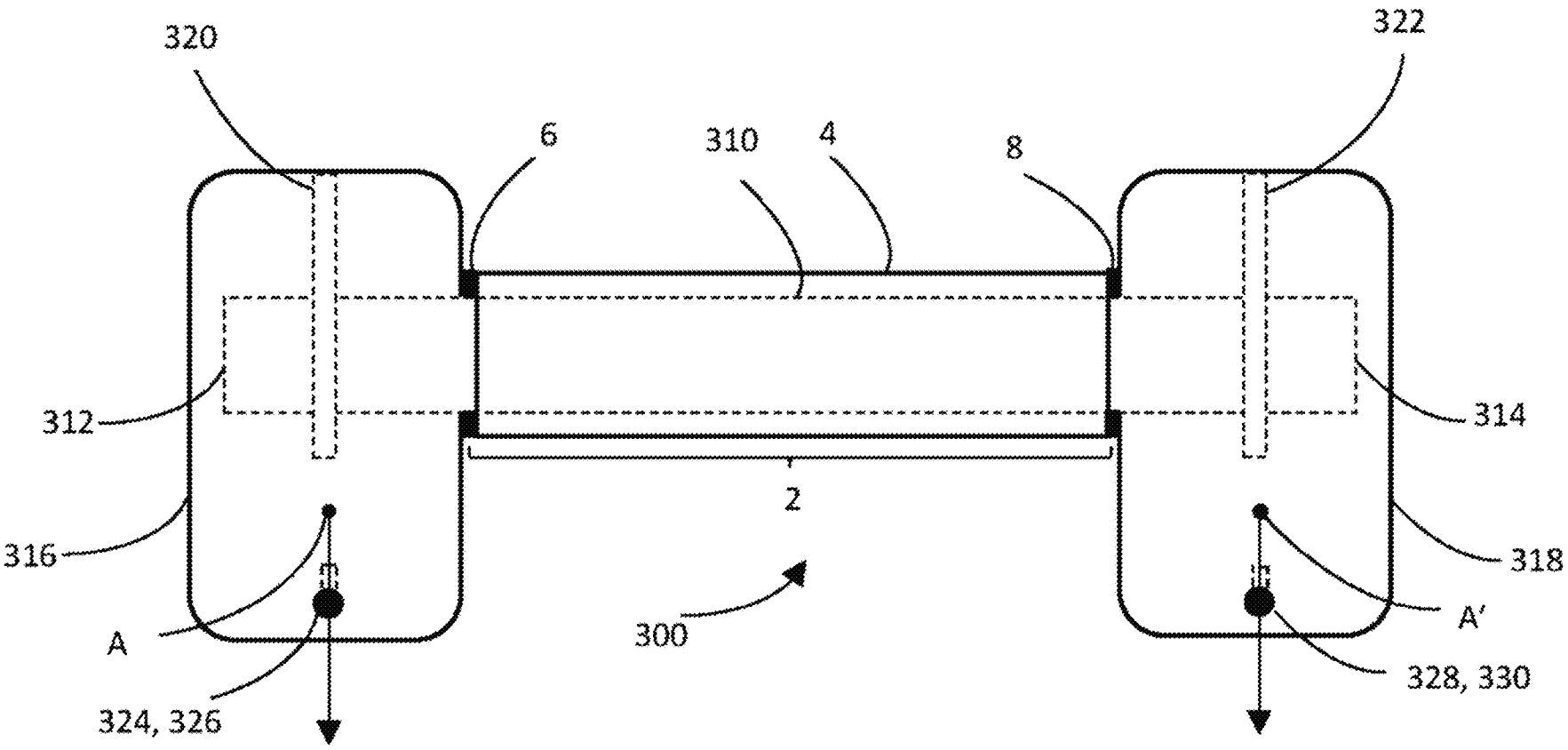
FIG. 3 is an elevation view of a weightlifting dumbbell device according to a third embodiment of present invention.

FIG. 3 shows third alternative embodiment of the weightlifting dumbbell device of the present invention described and claimed herein. The weightlifting dumbbell device comprises a round bar 300 with intermediate segment 310 and end segments 312 and 314. The bar 300 includes a primary axis lengthwise. The intermediate segment 310 includes a center point. Solid weight units 316 and 318 of equal mass are rigidly mounted around the end segments 312 and 314 respectively. Both the solid weight units 316 and 318 are equidistant from the center point. Handle assembly 2 comprising of a rotatable handle 4 and snap retaining rings 6 and 8 are mounted coaxially around the intermediate segment 310 in between the solid units 316 and 318. The handle 4 is used to grasp the weightlifting dumbbell device. A detailed description of the handle assembly 2 is given later along with FIG. 5. The shape of the solid weight units may be selected from a group of shapes which includes sphere, cylinder and regular prism wherein sides of the cylinder or the prism are oriented parallel to the primary axis. The aperture to mount the solid weight unit on the end segment is at an offset from the center of mass of the solid weight unit. The aperture in the solid weight unit may be a through hole or a blind hole as shown in FIG. 3. The solid weight unit 316 and 318 are mounted respectively on the end segments 312 and 314 in such a way that the center of mass of both the solid units are positioned at an equal offset in the same direction perpendicular to the primary axis. The positions of the center of mass of the solid weight units 316 and 318 is indicated by A and A' respectively. Therefore, throughout a standard dumbbell exercise, as long as the handle 4 is horizontal, the solid weight units 316 and 318, which are rigidly coupled to one another by the bar 300, pendulate together around the handle 4 under the influence of gravity in such a way that the center of mass A and A' of both the solid weight units lie plumb below the primary axis. As a result, the handle 4 spins and effects the exerciser's secondary and primary muscles in the same way as described before in this section. Standard methods practiced in the industry may be used to rigidly mount the solid weight unit around the end segment and may include but not be limited to welding, shrink fitting and use of shaft pins. FIG. 3 shows one such method where cylindrical solid weight units 316 and 318 are rigidly mounted on the end segments 312 and 314 respectively by using coiled spring pins 320 and 322 respectively. The coil spring pins 320 and 322 are driven across radial holes in the solid weight units 316 and 318 respectively and in the matching radial through holes in the bar 300. The coiled spring pins 320 and 322 expands within the holes and respectively fastens the solid weight units 316 and 318 to the bar 300. Anti-roll stops may be provided to prevent the weight lifting dumbbell device from rolling when it is laid on a supporting surface. For example, pair of rivets 324 and 326 and 328 and 330 are inserted respectively in holes drilled on the rim of the solid weight units 316 and 318 as shown in FIG. 3. Each rivet is located at same acute angle on either side of the line passing through center of the aperture and the center of mass of the solid unit. The rivets are made of wear resistant elastomer material. The head of the rivets that jut from the rim of the solid unit function as the anti-roll stop. A set of weightlifting dumbbell devices, each with solid weight unit of different mass, may be fabricated by using the art described for this embodiment.

Figure 4B:
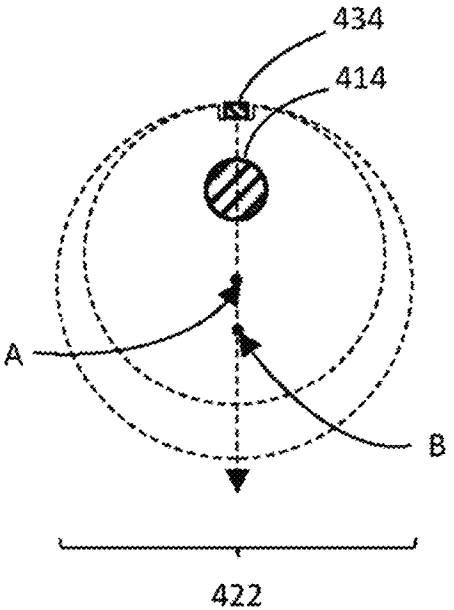
FIGS. 4A and 4B are an elevation view and a cross-sectional view along line Y-Y of FIG. 4A of a weightlifting dumbbell device according to a fourth embodiment of present invention.
Figure 4A:
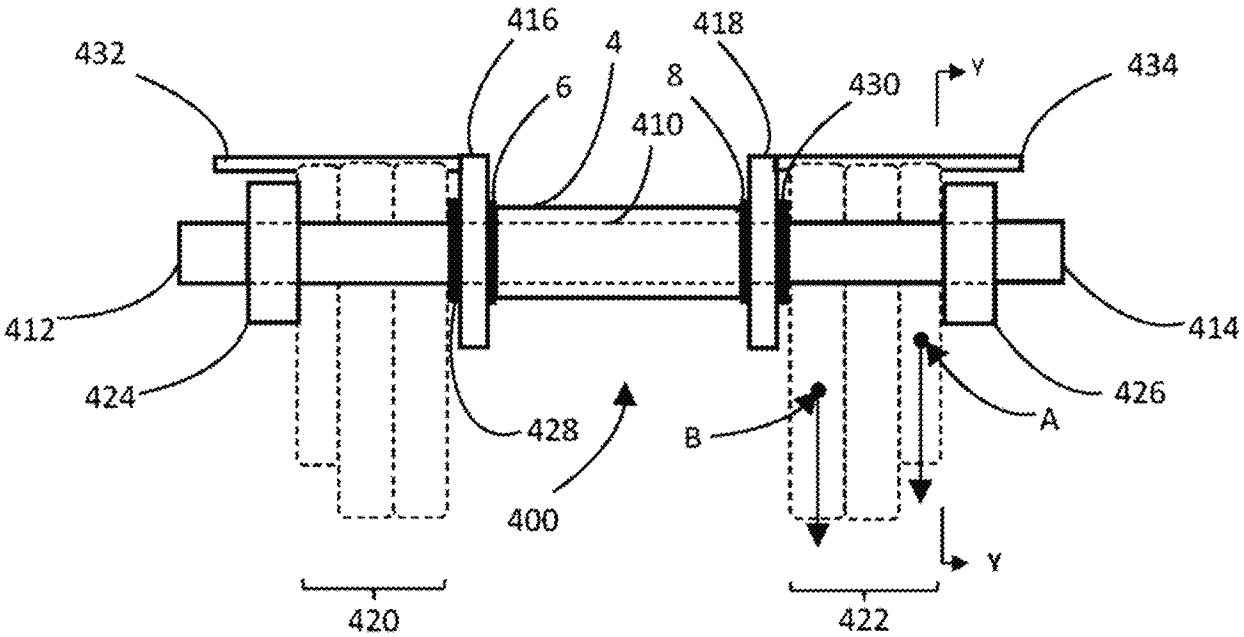

FIG. 4A shows fourth alternative embodiment of the weightlifting dumbbell device of the present invention described and claimed herein. The weightlifting dumbbell device comprises a round bar 400 with intermediate segment 410 and end segments 412 and 414. The bar 400 includes a primary axis lengthwise. The intermediate segment 410 includes a center point. Collars 416 and 418 are mounted rigidly around end segments 412 and 414 respectively. Both the collars 416 and 418 are equidistant from the center point. The end segments 412 and 414 extend beyond collars 416 and 418 respectively. Handle assembly 2 comprising of a rotatable handle 4 and snap retaining rings 6 and 8 is mounted coaxially around the intermediate segment 410 in between the collars 416 and 418. The handle 4 is used to grasp the weightlifting dumbbell device. A detailed description of the handle assembly 2 is given later along with FIG. 5. End segments 412 and 414 respectively receive a set of weight plates 420 and 422 with same mass quantity. Fasteners 424 and 426 that engage respectively with the end segments 412 and 414, secure the weight plates on the collars 416 and 418 respectively and restrict their linear and rotational movement relative to the end segments. The fasteners 424 and 426 may be selected from a group of standard fasteners used on standard barbells to secure weight plates. For end segments with plane outer surface as shown in FIG. 4A, the group of fasteners include clamp style collars, lock style collars and spring style collars. For end segments with external threads, said group of fasteners include anti-slip spin-lock collars and threaded anti-slip nuts. Flat disc elastomer washers 428 and 430 are mounted respectively around the end segments 412 and 414 immediately next to the collars 416 and 418 respectively, allowing the fasteners 424 and 426 to further secure the weight plates on the collars 416 and 418 respectively. Locating pins 432 and 434 are attached rigidly to the periphery of collars 416 and 418 respectively and extend in the direction parallel to the primary axis and away from the center point. The linear axes of the locating pins and the primary axis lie in the same plane. The length of the locating pins 432 and 434 are shorter than end segments 412 and 414 respectively which lets the exerciser to mount and rest the weight plate on the end segments before aligning the slot in the weight plate with the locating pins. All weight plates have the same shape. The shape may be selected from a group of shapes which includes circular as shown in FIG. 4A, 4B, oblong, square, rectangular, octagonal, or hexagonal. An open slot on the periphery of each weight plate accommodates locating pins 432 or 434. To load the weight plates on the end segment, the slot in each weight plate may be first aligned with one of the locating pins before sliding the weight plate along the end segment. The aperture to mount the weight plate on the end segments is located colinearly between the slot and the center of mass of the weight plate. The distance between the slot and the aperture is same for all weight plates. Accordingly, the slots in all the weight plates align and engage with the locating pins 432 or 434 after they are mounted on the end segments. The locating pins prevent the weight plates from rotating on the end segments during an exercise regime. At the same time, due to gravity, the center of the slot, the center of the aperture and the center of mass of the weight plate lie along a vertical line with the center of mass positioned at an offset below the aperture as shown in FIG. 4B. The positions of the center of mass of the weight plates are indicated by A and B. Accordingly, the center of mass of all the weight plates received by the end segments 412 and 414 lie plumb below the primary axis. Therefore, throughout a standard dumbbell exercise, as long as the handle 4 is horizontal, all the weight plates, which are rigidly coupled to one another by the bar 400, pendulate together around the handle 4 under the influence of gravity in such a way that the center of mass of all the weight plates lie plumb below the primary axis. As a result, the handle 4 spins and effects the exerciser's secondary and primary muscles in the same way as described before in this section. Locating pins 432 and 434 also function as anti-roll stops preventing said weight lifting dumbbell device from rolling when it is placed on a supporting surface.

Figure 5:
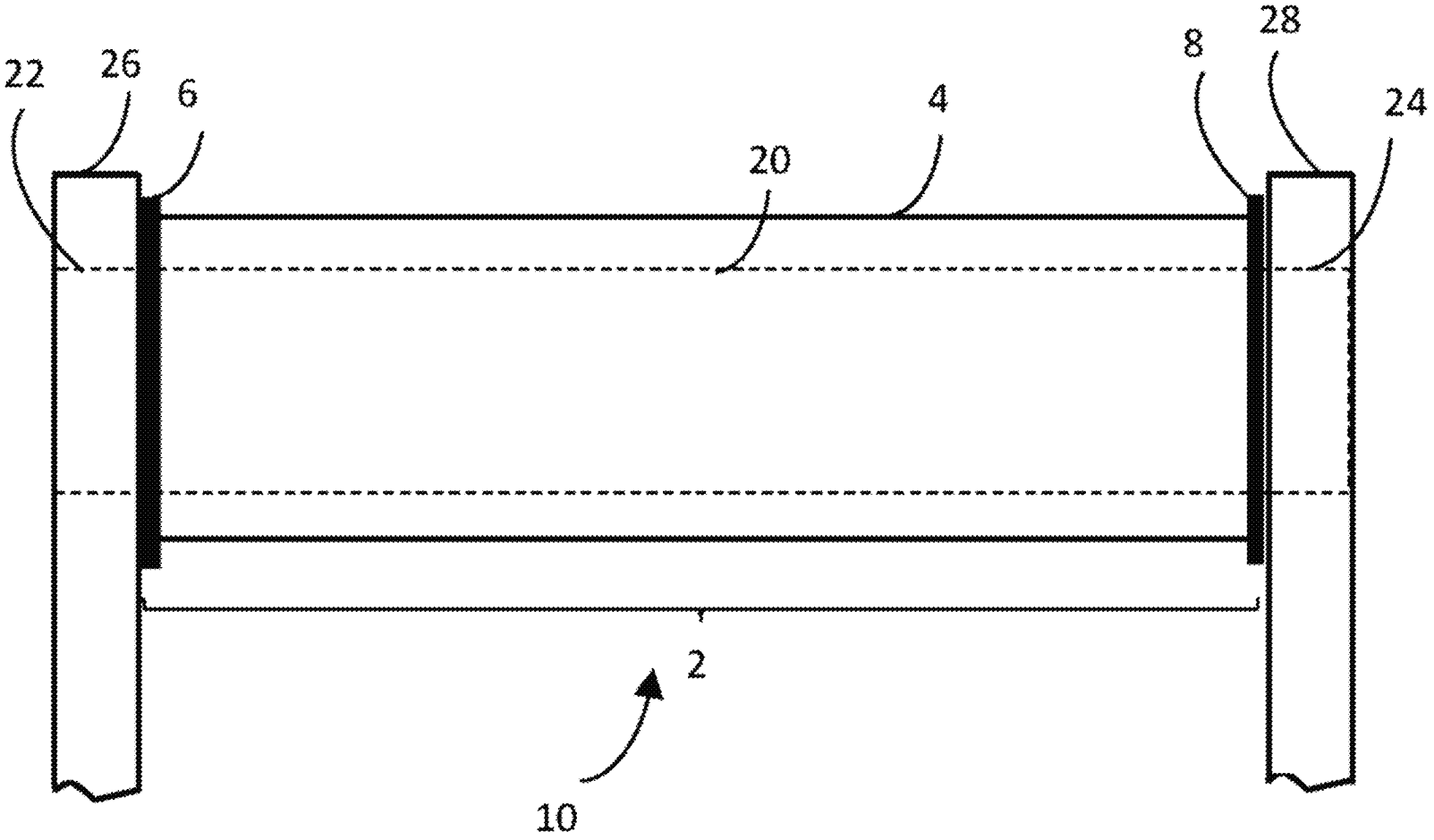
FIG. 5 is an elevation view of the handle according to the present invention.

FIG. 5 shows a configuration of the handle assembly 2 for the first embodiment of the weightlifting dumbbell device of the present invention that is shown in FIG. 1. The part numbering used in FIG. 5 is kept the same as in FIG. 1 in order to maintain consistency. Handle assembly with same configuration may be used for all embodiments of the present invention described and claimed herein. The handle assembly 2 comprises a rotatable handle 4 in form of solid sleeve mounted coaxially around the intermediate segment 20 of the main bar 10. Wear resistant metallic snap retaining rings 6 and 8 are mounted on the intermediate segment 20, on either side of the handle 4, in between the handle 4 and the brackets 26 and 28 respectively. The axial clearance between the handle and each bracket is minimally greater than the thickness of the snap retaining ring, just enough to permit free rotation of the handle 4 around the intermediate segment 20. The snap retaining rings 6 and 8 isolate the handle 4 from the brackets 26 and 28 respectively and also restrict the handle from moving along the main bar 10. The snap retaining rings 6 and 8 may be inserted on or removed from the intermediate segment 20 anytime, without having to dissemble the dumbbell device. The length and a diameter of the handle 4 are sized to allow comfortable gripping. The inner surface of the handle 4 and the mating surface of the intermediate segment 20 may be worked on, if necessary to reduce the friction between the two surfaces to a minimum. The radial clearance between inner side of the handle 4 and mating outside of the intermediate segment 20 is comparable to the typical clearance between a sleeve bearing and the mating rotating shaft. For a dumbbell exercise where the handle 4 remains in the horizonal position, the weights pendulate through a limited angle around the handle due to the restoring effect of gravity. For some exercises such as a dumbbell hammer curl however, where the handle 4 becomes inclined or vertical and the restoring effect of gravity on the weights reduces and the weights may not pendulate but swing all the way around the handle. In such situation the weight mass on the dumbbell wedges the snap retaining rings between the handle and the brackets and reduces the swing.

Figure 6:
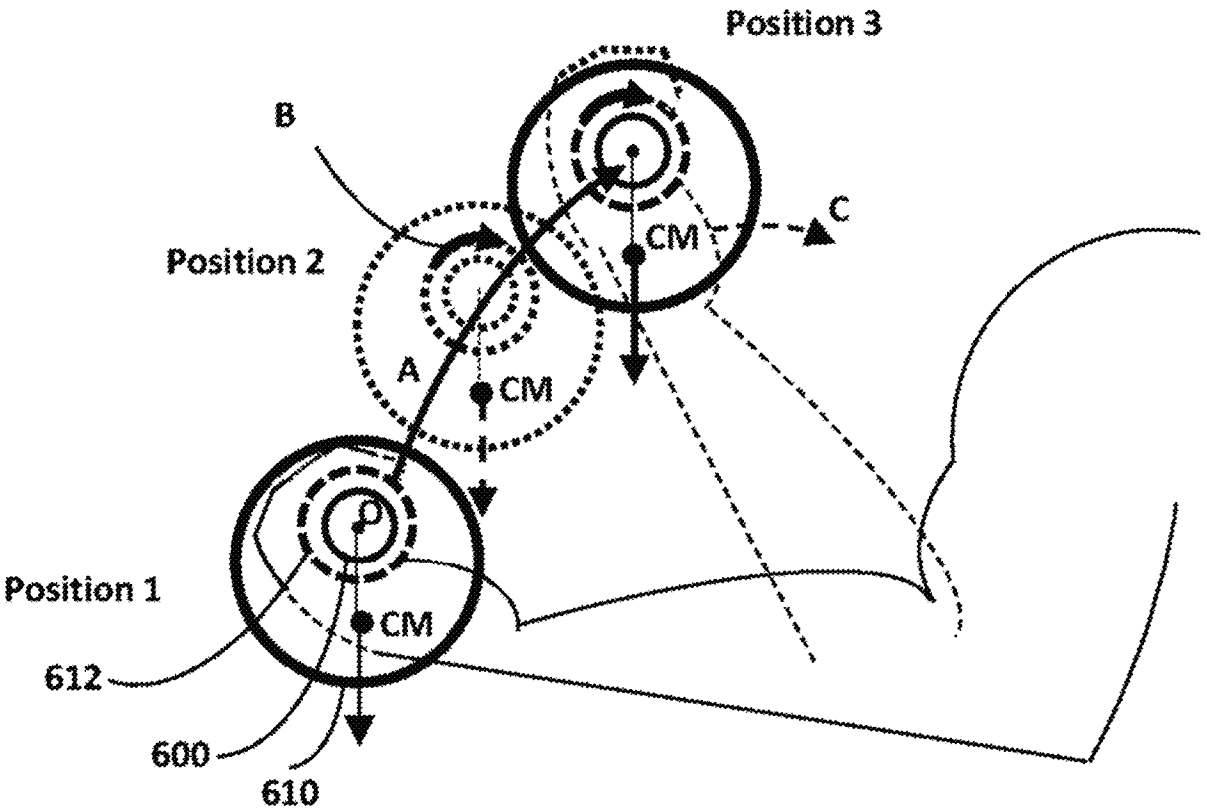
FIG. 6 illustrates the dynamics during an exercise with a fourth embodiment of present invention.
Figure 7:
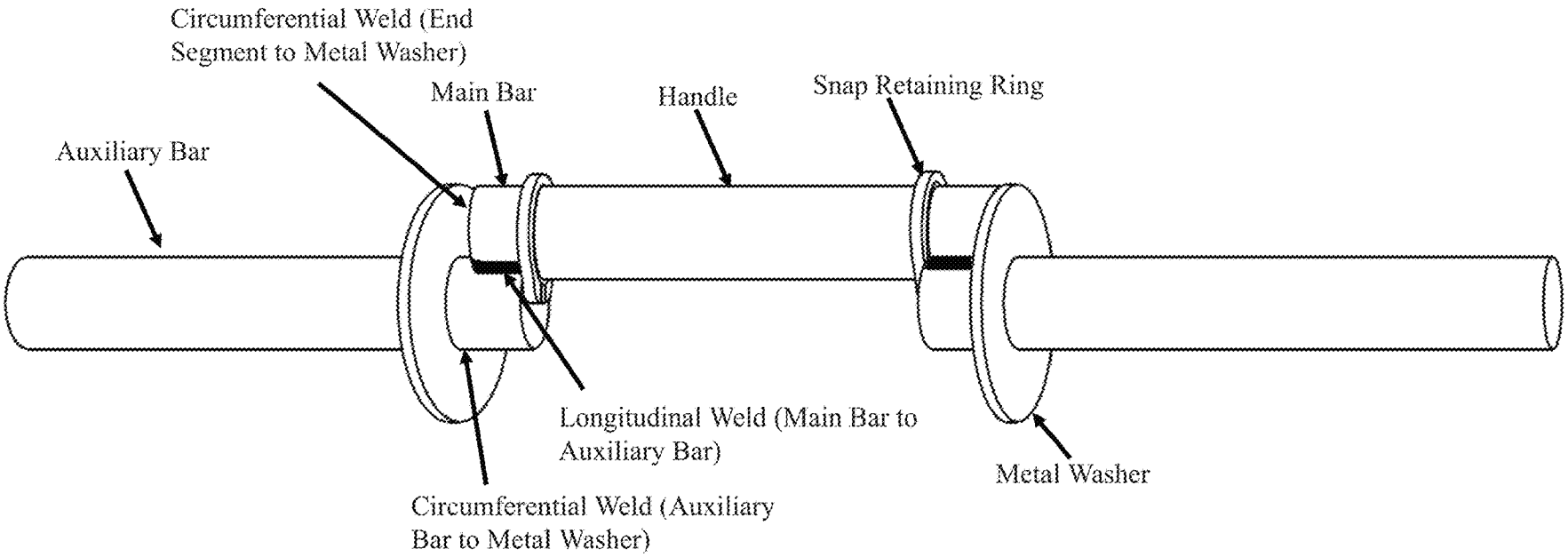
FIG. 7 is a protype of a weightlifting dumbbell device according to a second embodiment of the present invention.
Figure 8:
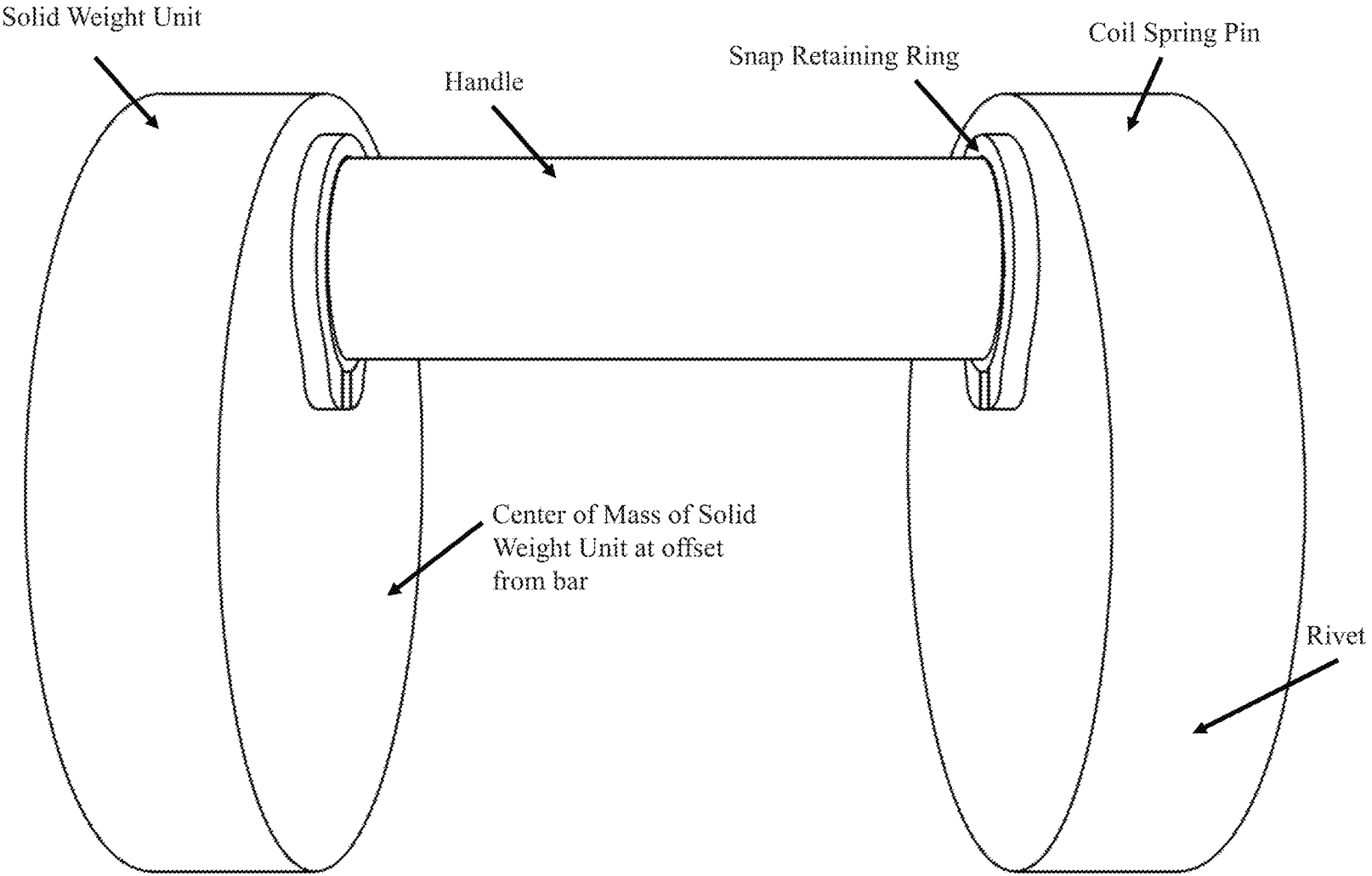
FIG. 8 is a protype of a weightlifting dumbbell device according to a third embodiment of the present invention.

FIG. 6 explains the dynamics during an exercise with a fourth embodiment of the weightlifting dumbbell device of the present invention described and claimed herein. The dynamics is the same for the other three embodiments of the present invention described and claimed herein. During a standard bicep curl exercise, the dumbbell device follows a curvilinear path indicated by arc A. The forearm is in the horizontal position at the start of the exercise with the weight plate 610 in position 1. The center of mass CM of the weight plate 610 is vertically offset below the center O of the bar 600, and is plumb below the longitudinal axis of the bar. The center of mass CM continues to remain plumb below the longitudinal axis of the bar due to gravity throughout the exercise including positions 2 and 3. As a result, the handle 612 keeps on spinning around the bar 600 towards the exerciser in the direction indicate by arrow B making it easy for the exerciser to curl the handgrip at the wrist towards the body in the direction indicated by arrow C. Accordingly, the workout of the primary muscle improves as explained before.

The embodiments described above are merely for the purpose of explaining the present invention. All variations, modifications and applications made by those skilled in the art within the scope of the spirit of the present invention are intended to be covered by the present invention.

I claim:

1. A weightlifting dumbbell device, said weightlifting dumbbell device comprising:

a round bar with an intermediate segment and an end segment on each side of said intermediate segment, said round bar including a primary axis lengthwise, said intermediate segment including a center point;

a handle configured to be used to grasp said weightlifting dumbbell device, said handle comprising a solid sleeve, said handle mounted coaxially around said intermediate segment, said handle configured to rotate around said intermediate segment during exercise;

a round rod attached to each said end segment at an outer circumference of said end segment, respectively, each said round rod having a longitudinal axis, and each said end segment having, at its furthest most portion from the center point, a radial center along said primary axis of said round bar;

wherein the longitudinal axis of each said round rod extend in a direction parallel to said primary axis and away from said center point;

wherein each said round rod partially overlaps the respective end segment lengthwise;

wherein each said round rod is located equidistant from said center point;

wherein the longitudinal axis of each said round rods is parallel to and offset from said primary axis;

wherein each said round rod is attached directly to their respective said end segments by weld seams on both sides of said overlaps, said weld seams spanning along said overlaps parallel to said primary axis; and wherein each said round rod is configured to be subjected to load from a respective mass element such that said mass elements pendulate together due to gravity during exercise to maintain a position of the center of mass of each said mass elements plumb below said primary axis.

2. The weightlifting dumbbell device of claim 1 further comprising:

said handle located between said round rods, said handle having an axial clearance on each side of the handle from each said round rod;

a pair of snap retaining rings inserted on said intermediate segment, each snap retaining ring of the pair of snap retaining rings having a thickness, wherein said pair of snap retaining rings are each placed on a respective side of said handle into the axial clearance; and said pair of snap retaining rings restricting said handle from moving along said round bar and at the same time permitting said handle to rotate on said intermediate segment.

3. The weightlifting dumbbell device of claim 2 further comprising:

a flat disc metal washer mounted around each said round rod, each said flat disc metal washer adjacent a respective end segment; and wherein each said flat disc metal washer is welded to its respective said round rod along a mating circumference of each said round rod on the side of the flat disc metal washer that faces the center point.

4. The weightlifting dumbbell device of claim 3 wherein each said flat disc metal washer is welded to its respective adjacent end segment along a mating circumference of each said end segment.

5. The weightlifting dumbbell device of claim 1 further comprising:

a flat disc metal washer mounted around each said round rod, each said flat disc metal washer adjacent a respective end segment; and wherein each said flat disc metal washer is welded to its respective said round rod along a mating circumference of each said round rod on the side of the flat disc metal washer that faces the center point.

6. The weightlifting dumbbell device of claim 5 wherein each said flat disc metal washer is welded to its respective adjacent end segment along a mating circumference of each said end segment.

7. The weightlifting dumbbell device of claim 1 wherein each said mass elements comprises a set of weight plates of a same nominal mass quantity; wherein each said round rod is configured to receive a respective said mass element and a fastener; and wherein each said fastener engages with its respective round rod and secures each said respective mass element against linear movement along its respective said round rod.

8. The weightlifting dumbbell device of claim 7 wherein both said round rods position the center of mass of said mass elements along the longitudinal axis of the respective round rod parallel to said primary axis.

* * * * *